US006991272B2

(12) United States Patent
Kalsi

(10) Patent No.: US 6,991,272 B2
(45) Date of Patent: Jan. 31, 2006

(54) VEHICLE LATCH ASSEMBLY

(75) Inventor: Gurbinder Singh Kalsi, Oldbury (GB)

(73) Assignee: ArvinMeritor Light Vehicle Systems (UK) Ltd. (GB)

( * ) Notice: Subject to any disclaimer, the term of this patent is extended or adjusted under 35 U.S.C. 154(b) by 194 days.

(21) Appl. No.: 10/463,078

(22) Filed: Jun. 17, 2003

(65) Prior Publication Data

US 2003/0230902 A1 Dec. 18, 2003

(30) Foreign Application Priority Data

Jun. 18, 2002 (GB) ..... 0213908

(51) Int. Cl.
*E05B 3/00* (2006.01)

(52) U.S. Cl. ..... 292/336.3; 292/DIG. 22

(58) Field of Classification Search ..... 292/201, 292/216, DIG. 22, DIG. 4, 336.3
See application file for complete search history.

(56) References Cited

U.S. PATENT DOCUMENTS 3,719,248 A * 3/1973 Breitschwerdt et al. ..... 180/271
4,928,374 A * 5/1990 Allen ..... 29/436
4,948,184 A * 8/1990 Weyerstall et al. ..... 292/216
5,979,951 A * 11/1999 Shimura ..... 292/216
6,109,671 A * 8/2000 Roncin et al. ..... 292/216
6,573,921 B2 * 6/2003 Hayashi ..... 347/131

FOREIGN PATENT DOCUMENTS

EP 1 182 310 A2 2/2002

* cited by examiner

*Primary Examiner*—Gary Estremsky
(74) *Attorney, Agent, or Firm*—Carlson, Gaskey & Olds

(57) ABSTRACT

A vehicle latch assembly includes a release lever and a pawl, the release lever having a locked, an unlocked and a release position where the unlocked position is on the path of movement of the release lever from the release position to the locked position. The release lever is biased by a biasing means toward the unlocked position when it is in the release position. The latch assembly is arranged so that the release lever moves toward the locked position due to the biasing force of the biasing means when the release lever is released. The kinetic energy of the release lever is transferred to the pawl in the latch assembly, and the pawl uses the transferred kinetic energy to prevent the release lever from reaching the locked position. When the release lever is stationary in the unlocked position, the pawl does not prevent movement of the release lever from the unlocked to the locked position.

13 Claims, 3 Drawing Sheets

VEHICLE LATCH ASSEMBLY

REFERENCE TO RELATED APPLICATIONS

The present invention claims priority from United Kingdom (GB) patent application number 0213908.7, filed Jun. 18, 2002.

TECHNICAL FIELD

The present invention relates to latch assemblies, in particular to latch assemblies for releasing, locking and unlocking vehicle closures.

BACKGROUND OF THE INVENTION

In currently known vehicle latch assemblies, a door handle (e.g., an inside door handle) can have a locked, an unlocked and a release position. The locked and unlocked positions are stable positions; that is, when the handle is placed in the locked position or the unlocked position, it stays in that position. However, moving the inside handle to the release position requires the inside handle to oppose a spring biasing force in the latch assembly. The inside handle is therefore unstable in the release position and will return toward the unlocked position when released due to the spring biasing force.

Pulling the handle from the locked position to the unlocked position unlocks the door. Further movement of the handle to the released position then unlatches the door. If the handle is pulled to unlatch the door and then released quickly, there is the possibility that excess spring biasing forces on the handle will cause the handle to move past the unlocked position back to the locked position. This phenomenon is called "snap back" locking and potentially causes customer dissatisfaction.

Although it may be possible to reduce the spring force to prevent the release handle from snapping back past the unlocked position to the locked position, adjusting the spring force is not always possible since the spring forces must still be kept high enough to both resist the inertia of system components during crash deceleration and return all moving elements to their rest positions to ensure full engagement of the latch pawl and claw in the latch assembly. It may also be possible to increase the locking mechanism spring force to counter the spring force in the system, but this would undesirably increase the effort needed to operate a key in the latch assembly.

One suggested solution is described commonly-assigned, co-pending patent application EP1182310, where the "snap back" phenomenon is overcome by using the inertial and/or centripetal forces associated with the handle movement to move an element that is pivotally mounted on the handle. The element prevents the handle from moving to the locked position from the released position.

An object of the present invention is to provide an alternative method of overcoming the "snap back" phenomenon.

SUMMARY OF THE INVENTION

The present invention is directed to a vehicle latch assembly including a release lever and a pawl, the release lever having a locked, an unlocked and a release position where the unlocked position is in the path of movement of the release lever from the release position to the locked position. The release lever is biased by a biasing means toward the unlocked position when it is in the release position. The latch assembly is arranged so that the release lever moves toward the locked position due to the biasing force of the biasing means when the release lever is released. The kinetic energy of the release lever is transferred to the pawl in the latch assembly, and the pawl uses the transferred kinetic energy to prevent the release lever from reaching the locked position. When the release lever is stationary in the unlocked position, the pawl still allows movement of the release lever from the unlocked to the locked position.

In one embodiment, the kinetic energy in the release lever is transferred to the pawl by engagement between a first engagement region of the release lever and a first engagement region of the pawl. Preferably, the first engagement region of the pawl lies in the path of the first engagement region of the release lever as the release lever moves from the released position to the unlocked position. Thus, the first engagement regions will always engage when the release lever is released from the release position.

In one embodiment, the pawl has a second engagement region, and the release lever has a second engagement region, and the transfer of kinetic energy from the release lever to the pawl moves the pawl to a position where the second engagement region of the pawl and the second engagement region of the release lever engage to prevent the release lever from reaching the locked position.

Because the inventive structure ensures that the first engagement regions of the pawl and the release lever always engage, at a given level of kinetic energy in the release lever, the pawl will move to a position where the second engagement regions engage, and therefore the release lever is prevented from snapping back into the locked position.

BRIEF DESCRIPTION OF THE DRAWINGS

The invention will now be described, by way of example only, with reference to the accompanying drawings in which.

DETAILED DESCRIPTION OF THE EMBODIMENTS

Figure 1:
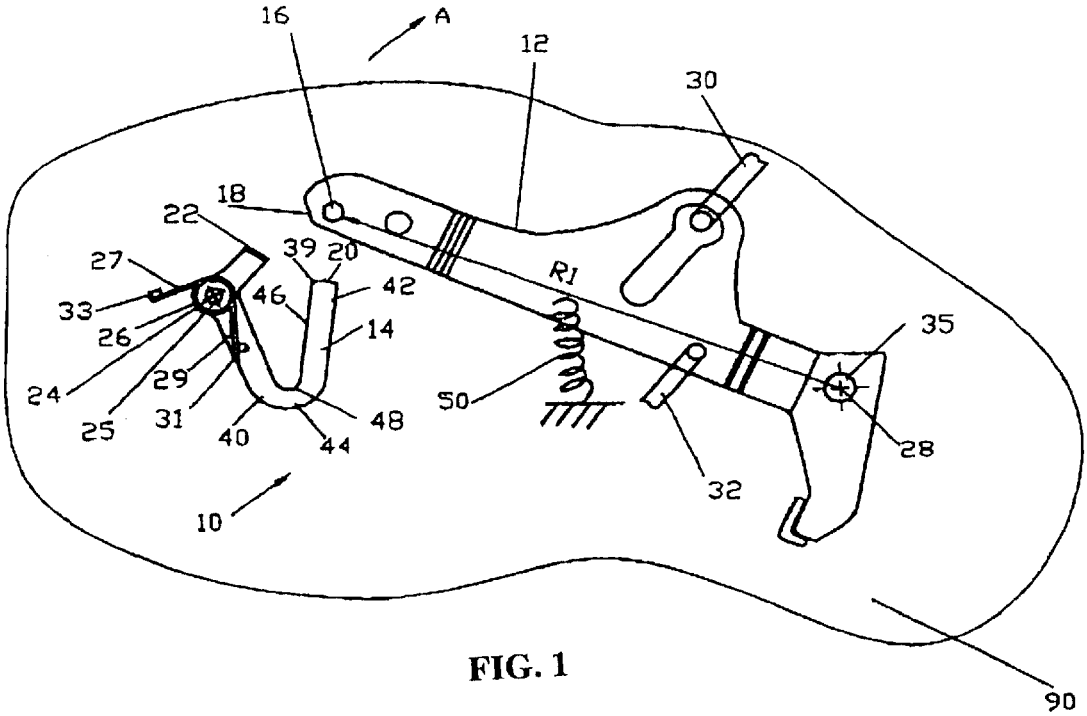
FIG. 1 is a view of an assembly with the release lever in the release position according to one embodiment of the present invention.
Figure 1A:
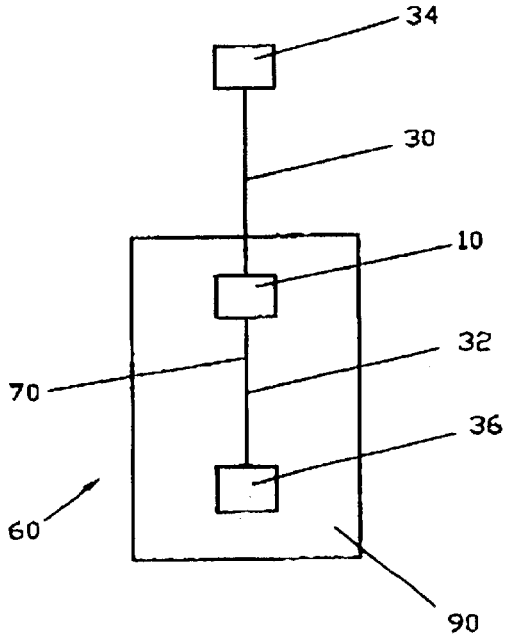
FIG. 1A is a schematic view of a latch arrangement including the assembly of FIG. 1.

FIGS. 1 and 1A show a latch arrangement 60 having a latch assembly 10 according to one embodiment of the invention. The latch arrangement 60 includes a latch assembly 10 and a latch housing 90.

The latch assembly 10 includes a latch 36 and a release handle 34 that is operable to release, lock, and unlock the latch. Although the examples described below focus on an inside release handle and its associated operating parts, the invention is not limited in this manner and can be incorporated with any handle in any latch mechanism.

The latch 36 is housed within the latch housing 90. Typically, the latch housing 90 is fixed to part of a vehicle door, such as a door inner skin (not shown). In other embodiments, the latch housing may be fixed to another part of the vehicle door, for example, a door module (not shown).

The assembly 10 includes a release lever 12 and a pawl 14, both of which are pivotally attached to the latch housing 90.

In other embodiments the release lever 12 and pawl 14 may be attached to a point remote from the latch housing, for example on an inside handle housing, with the inside handle housing being fixed to part of a vehicle door.

The release lever 12 is pivotally attached to the latch housing 90 at a release lever pivot 28 using a pin 35. The pawl 14 is pivotally attached to the latch housing 90 at a pawl pivot 24 using a pin 25. The pawl 14 and the release lever 12 rotate about separate pivot points 24, 28 on the latch housing 90, and the pawl 14 rotates independently from the release lever 12.

The release lever 12 of the latch assembly 10 is connected to the latch 36 by a latch rod 32 and to the inside handle 34 by an inside handle rod 30. The latch rod 32, the inside handle rod 30, and the latch assembly 10 together form a transmission path 70 between the latch 36 and the inside handle 34, operably connecting the inside handle 34 to the latch 36.

Figure 4:
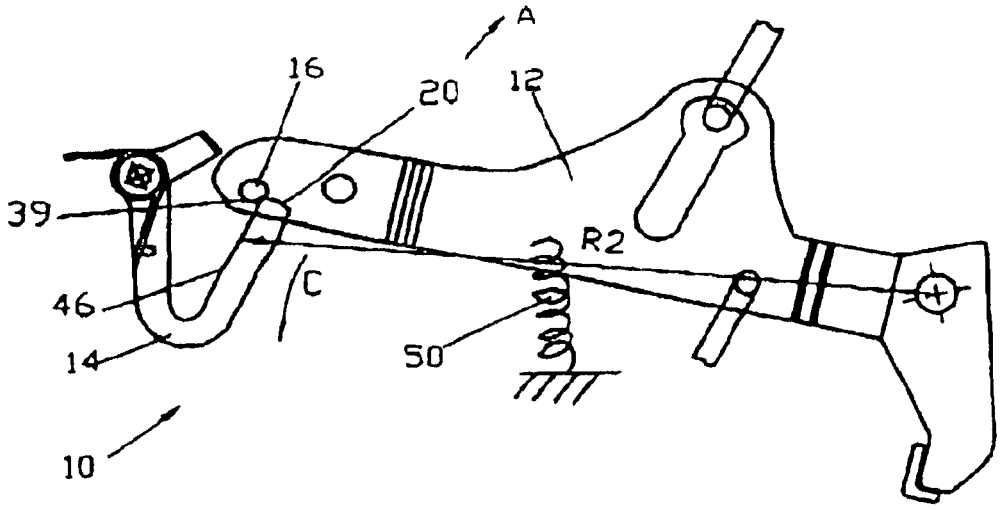
FIG. 4 is a view of the assembly of FIG. 1 with the release lever in the unlocked position.
Figure 5:
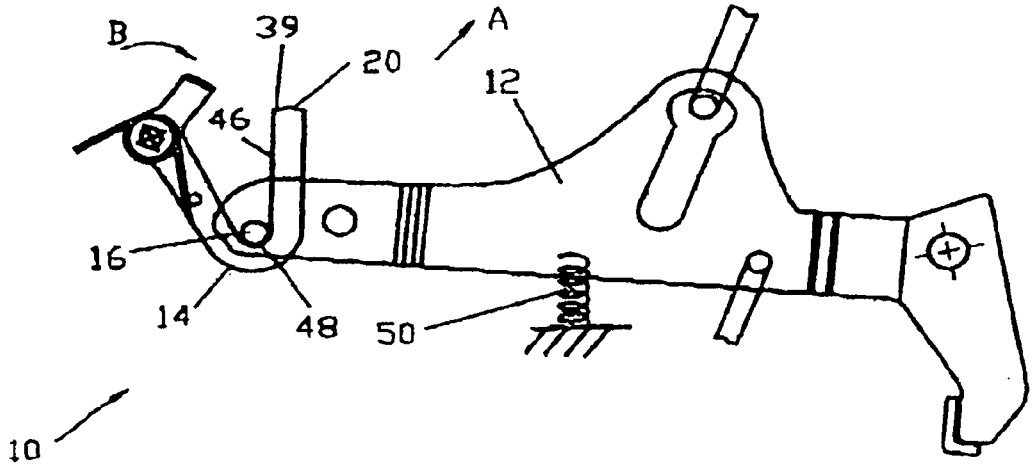
FIG. 5 is a view of the assembly of FIG. 1 with the release lever in the locked position.

The release lever 12 is movable between a release position as shown in FIG. 1, an unlocked position as shown in FIG. 4, and a locked position as shown in FIG. 5, which respectively correspond to equivalent released, unlocked and locked conditions of the latch. The release, unlocked and locked positions all correspond to equivalent positions of the inside handle 34; that is, moving the inside handle 34 to the release, unlocked or locked position will also move the release lever 12 to the release, unlocked or locked position, respectively.

The assembly includes a biasing means, such as a release lever spring 50 (shown schematically), that biases the release lever 12 towards the unlocked position from the release position. As can be seen by comparing FIGS. 1, 4, and 5, the unlocked position lies between the released and the locked position.

The release lever 12 includes a first lever engagement region in the form of an engagement pin 16 and a second lever engagement region 18. The engagement pin 16 moves on a radius $R_1$ as the release lever 12 moves about its pivot 28.

In the illustrated embodiment, the pawl 14 is U-shaped with a first arm 40 and a second arm 42. The first and second arms 40, 42 meet at a curved portion 44. The second arm 42 has an inside arm surface 46 and the curved portion has an inside curved surface 48. The inside arm surface 46 is in the form of an arc having a radius $R_2$.

The first arm 40 has a first pawl engagement region 20 and the second arm 42 has a second pawl engagement region 22. The first pawl engagement region 20 has a rounded edge profile 39 where it meets the inside arm surface 46. The pawl 14 is pivotally mounted part way along second arm 42 on the pin 25 of the housing 90.

A helical pawl spring 26 is located on the pin 25, with a first end 29 abutting against a pawl spring stop 31 located on the first arm 40 and a second end 27 abutting against a latch housing spring stop 33 located on the latch housing 90. The pawl spring 26 and the two stops 31, 33 are arranged such that the pawl 14 is biased counterclockwise against a further stop (not shown) to a first pawl position as shown in FIG. 1.

Figure 2:
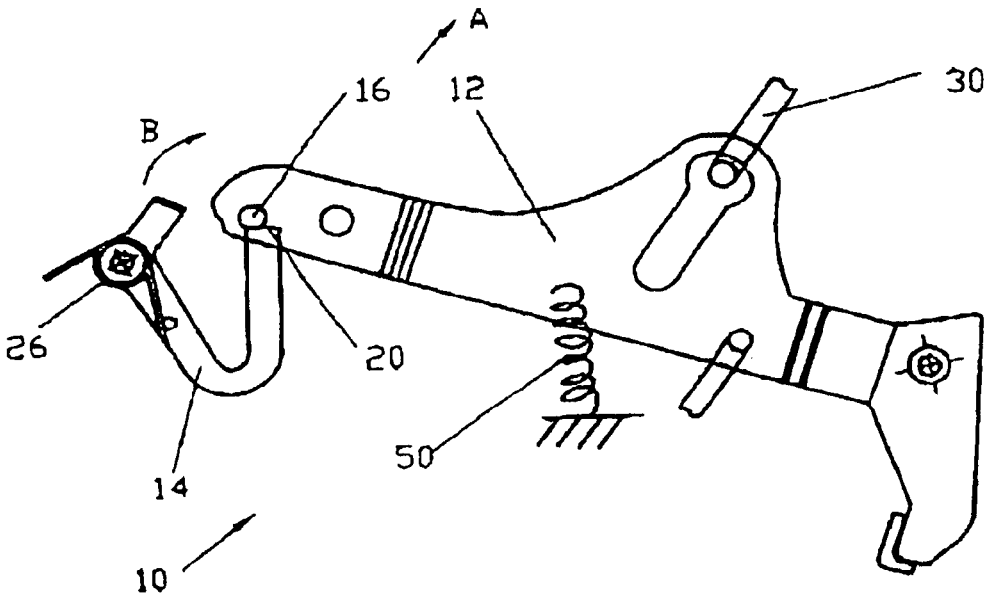
FIG. 2 is a view of the assembly of FIG. 1 just after release of the release lever from the position shown in FIG. 1.

Starting at the unlocked position shown in FIG. 2, opening the vehicle door from inside the vehicle is conducted by pulling the inside handle 34 to release the latch 36. Pulling the inside handle 34 moves the release lever 12 in the direction of arrow A and moves rod 32 to unlatch the latch 36. The movement of the release lever 12 to the release position (FIG. 1) moves against the direction of the biasing force in the release lever spring 50, thereby storing energy in the release lever spring 50.

FIGS. 1 to 4 illustrate the sequence of events that occurs when the inside handle is released quickly. When the release lever 12 is released quickly from the release position, it rotates counterclockwise relatively quickly about pivot 28 toward the unlocked position due to the biasing force of the release lever spring 50.

Just before the release lever 12 reaches the unlocked position, the engagement pin 16 in the release lever 12 engages with the first pawl engagement region 20. As shown in FIGS. 1 and 2, when the pawl 14 is in the first pawl position (FIG. 1), the first pawl engagement region 20 lies in the path of movement of the pin 16 of the release lever 12 as the release lever 12 moves from the release to the unlocked position.

The movement of the release lever 12 from the release position under the action of the release lever spring 50 generates kinetic energy in the release lever 12. The kinetic energy in the release lever 12 is transferred to the pawl 14 after engagement between the engagement pin 16 in the release lever 12 and the first pawl engagement region 20. The transfer of kinetic energy is sufficient to overcome the pawl spring force and move the pawl 14 counterclockwise (in the direction of arrow B) momentarily to a second pawl position as shown in FIG. 3.

Figure 3:
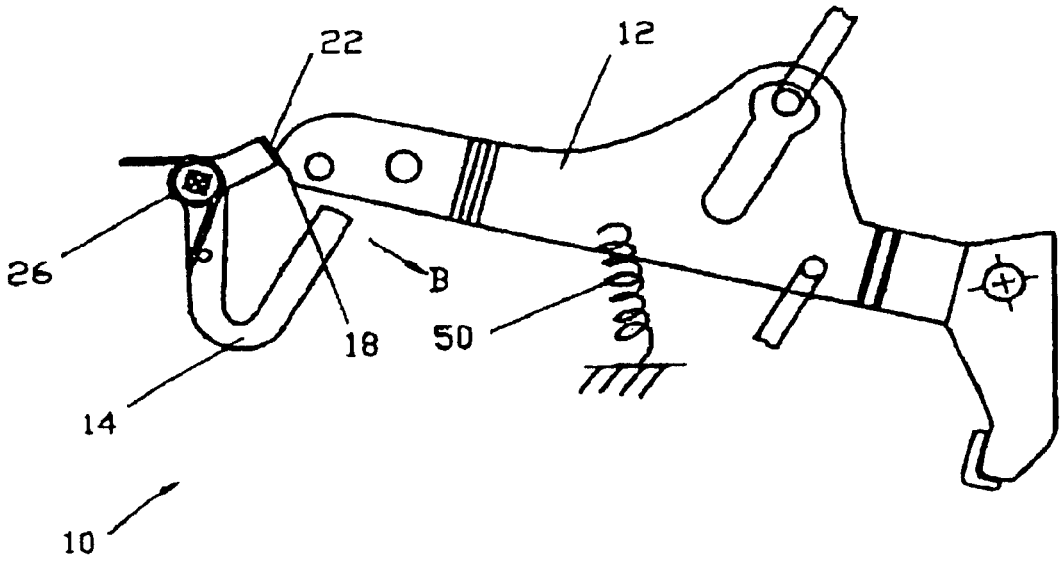
FIG. 3 is a view of the assembly of FIG. 1 just after engagement between the first engagement regions of the release lever and the pawl has occurred.

It can be seen in FIG. 3 that when the pawl 14 is in the second pawl position, the second engagement region 22 of the pawl momentarily engages with the second engagement region 18 of the release lever, and thus the release lever 12 is prevented from further clockwise movement towards the locked position. Thus, the clockwise movement of the pawl has caused the second engagement region 22 to momentarily lie in the path of movement of the second engagement region 18.

Thus it is the kinetic energy generated in the release lever due to the release lever spring which has resulted in a transfer of kinetic energy to the pawl which is sufficient to move the pawl to prevent further movement of the release lever towards the locked position.

After engagement between the second engagement regions 18 and 23, the pawl 14 and the release lever 12 will both become momentarily stationary, i.e. the release lever 12 will cease to move towards the locked position, and the pawl 14 will cease to move in the direction of arrow B, and a reaction force between the pawl and release lever second engagement regions will cause disengagement. This disengagement allows the pawl 14 to move back towards the second pawl position under the action of the pawl spring 26 as shown in FIG. 4.

After the pawl 14 has returned to the first pawl position, the release lever 12 remains in the unlocked position as shown in FIG. 4. It will be appreciated that as the pawl 14 and the release lever 12 disengage, the release lever 12 may move slightly, with the engagement pin 16 coming into contact with the rounded edge profile 39.

The sequence of events shown in FIGS. 1 to 4 can be contrasted with the operation of the assembly when the inside handle is only released relatively slowly, i.e., when the inside handle is allowed to move from the release position to the unlocked position only relatively slowly. Under these circumstances, the speed of movement of the components is lower and hence the levels of kinetic energy are lower. Thus under these circumstances the components move relatively slowly from the position shown in FIG. 1 to the position shown in FIG. 4, and at no time will second engagement region 22 lie in the path of second engagement region 18. However, under these circumstances, because the components are moving slower, 'snap back' locking will not occur, and thus active prevention of 'snap back' locking is not required.

Thus it can be seen that 'snap back' locking is actively prevented when it would otherwise occur (i.e. when the components are allowed to move relatively quickly) and 'snap back' locking is not actively prevented when it would not otherwise occur.

When the components stationary in the unlocked position shown in FIG. 4, it can be seen that the second engagement region 22 of the pawl no longer lies in the path of the second engagement region of the release lever 12. Hence, the release lever is not restricted from moving to the locked position in FIG. 5.

Thus, pushing the inside handle 34 and thus release lever 12 counterclockwise in the direction of arrow C toward the locked position will cause engagement pin 16 on the release lever 12 to move past the rounded edge profile 39 of the pawl 14 and then along the inside surface 46 of the pawl 14 to the position shown in FIG. 5.

Note that the pawl 14 may be moved slightly clockwise beyond the first pawl position due to contact between the engagement pin 16 and the inside arm surface 46 as the release lever 12 is moved to the locked position.

From the locked position of FIG. 5, the release lever 12 can either be moved just to the unlocked position or straight to the release position by appropriate operation of the inside door handle. In particular, the speed of unlocking for release is not affected by the pawl 14.

It should be understood that various alternatives to the embodiments of the invention described herein may be employed in practicing the invention. It is intended that the following claims define the scope of the invention and that the method and apparatus within the scope of these claims and their equivalents be covered thereby.

What is claimed is:

1. A control assembly for a latch, comprising:

a release lever movable between a locked, an unlocked and a release position, the unlocked position being in a movement path of the release lever between the release position and the locked position, the release lever having a first lever engagement region and a second lever engagement region;

a release lever biasing means that biases the release lever toward the unlocked position when the release lever is in the release position;

a pawl having a first pawl engagement region and a second pawl engagement region, wherein the pawl receives kinetic energy from the release lever when the release lever is released from the release position through engagement between the first release lever engagement region and the first pawl engagement region, wherein the pawl moves toward the locked position due to the release lever biasing means, and wherein the kinetic energy moves the second pawl engagement region into the movement path of the release lever such that the second pawl engagement region engages with the second release lever engagement region to prevent movement of the release lever to the locked position.

2. The assembly according to claim 1, wherein the first pawl engagement region lies in a path of the first release lever engagement region when the release lever moves from the release position to the unlocked position.

3. The assembly according to claim 1, wherein the first release lever engagement region is a pin.

4. The assembly according to claim 1, wherein the pawl is rotatably mounted and moves independently from the release lever.

5. The assembly according to claim 1, wherein the pawl is positioned away from the release lever when the release lever is stationary in the unlocked position so that the pawl allows movement of the release lever from the unlocked to the locked position.

6. A vehicle latch assembly, comprising:

a latch;

a handle movable between a locked, an unlocked, and a release position;

a control assembly comprising a release lever having a locked, an unlocked and a release position, the unlocked position being in a movement path of the release lever between the release position and the locked position, the release lever having a first lever engagement region and a second lever engagement region, a release lever biasing means that biases the release lever toward the unlocked position when the release lever is in the release position, and a pawl having a first pawl engagement region and a second pawl engagement region, wherein the pawl receives kinetic energy from the release lever when the release lever is released from the release position through engagement between the first release lever engagement region and the first pawl engagement region, wherein the pawl moves toward the locked position due to the release lever biasing means, wherein the kinetic energy moves the second pawl engagement region into the movement path of the release lever such that the second pawl engagement region engages with the second release lever engagement region to prevent movement of the release lever to the locked position; and a transmission path disposed between the inside handle and the latch, wherein movement of the handle between the locked, unlocked and release positions corresponds to movement of the release lever between the locked, unlocked and release positions.

7. The vehicle latch assembly according to claim 6, further comprising a latch housing, wherein the control assembly is mounted to the latch housing.

8. The vehicle latch assembly according to claim 6, wherein the handle is housed in a handle housing, and wherein the control assembly is mounted to the handle housing.

9. The vehicle latch assembly according to claim 6, wherein the handle is an inside door handle.

10. The assembly according to claim 9, wherein the first pawl engagement region lies in a path of the first release lever engagement region when the release lever moves from the release position to the unlocked position.

11. The assembly according to claim 9, wherein the first release lever engagement region is a pin.

12. The assembly according to claim 6, wherein the pawl is rotatably mounted and moves independently from the release lever.

13. The assembly according to claim 6, wherein the pawl is positioned away from the release lever when the release lever is stationary in the unlocked position so that the pawl allows movement of the release lever from the unlocked to the locked position.

* * * * *

UNITED STATES PATENT AND TRADEMARK OFFICE

CERTIFICATE OF CORRECTION

PATENT NO. : 6,991,272 B2
APPLICATION NO. : 10/463078
DATED : January 31, 2006
INVENTOR(S) : Gurbinder Singh Kalsi It is certified that error appears in the above-identified patent and that said Letters Patent is hereby corrected as shown below:

Column 5:

Line 51: Please add --release-- after “first”
Line 52: Please add --release-- before “lever”

Column 6:

Line 26: Please add --release-- after “first”
Line 27: Please add --release-- after “second”
Line 45: Please delete “inside”

Please change the dependency of Claims 10 and 11 as follows:

Line 59: Please delete “9” and insert --6--
Line 63: Please delete “9” and insert --6--

Signed and Sealed this

Twenty-third Day of January, 2007

JON W. DUDAS
*Director of the United States Patent and Trademark Office*